United States Patent [19]

Thornell

[11] 4,184,275

[45] Jan. 22, 1980

[54] REUSABLE BADGE

[76] Inventor: Ernest L. Thornell, 412 Clark St., Horicon, Wis. 53032

[21] Appl. No.: 847,573

[22] Filed: Nov. 1, 1977

[51] Int. Cl.[2] ..... A44C 3/00

[52] U.S. Cl. ..... 40/1.5

[58] Field of Search ..... 40/100, 1.5, 10 R, 40/315, 156, 154

[56] References Cited

U.S. PATENT DOCUMENTS

| | | | |
|---|---|---|---|
| 736,751 | 8/1903 | Lobmiller | 40/10 D X |
| 1,330,599 | 2/1920 | Magid | 40/1.5 |
| 2,411,987 | 12/1946 | D'Antonio | 40/1.5 |
| 3,212,204 | 10/1965 | Smith | 40/1.5 |
| 3,407,523 | 10/1968 | Winston | 40/1.5 |
| 3,877,162 | 4/1975 | Wilson | 40/10 D |

*Primary Examiner*—Russell R. Kinsey
*Assistant Examiner*—Wenceslao J. Contreras
*Attorney, Agent, or Firm*—Bacon & Thomas

[57] ABSTRACT

A reusable badge is assembled by snapping a flanged concavo-convex lens of resilient sheet plastic material over the edge of a stiff but resilient backing plate with display material between them. The display material can be from a large sheet and sheared to size by the lens flange and backing plate as they are assembled. A press for assembling the components has an anvil with a centering boss that engages a hole in a clip secured to the backing plate. A hammer member presses the lens downwardly to snap its flange over the edge of the backing plate while flexing the edge of the backing plate slightly.

3 Claims, 10 Drawing Figures

Fig. 1.
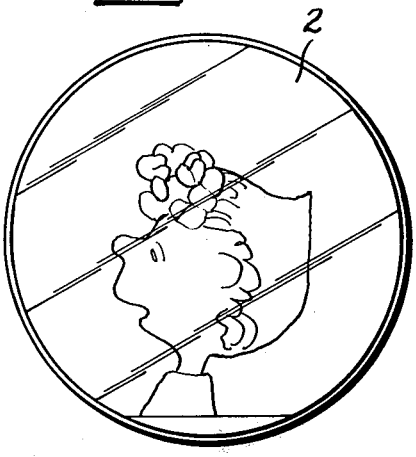
Fig. 2.
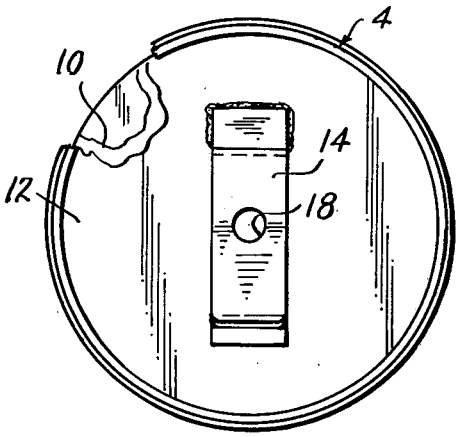
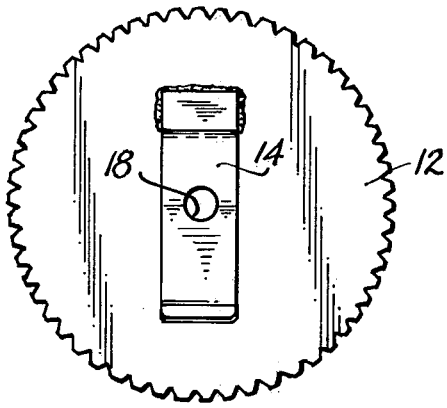
Fig. 3.
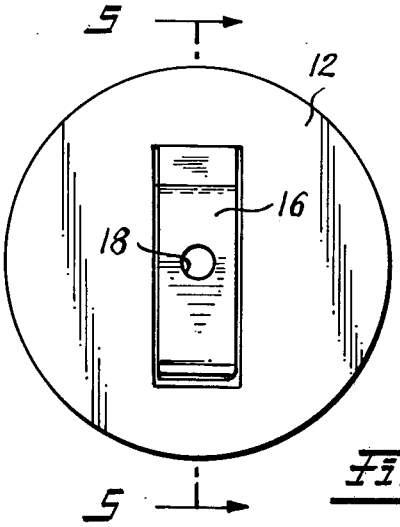
Fig. 4.
Fig. 5.
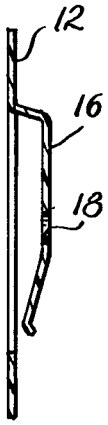

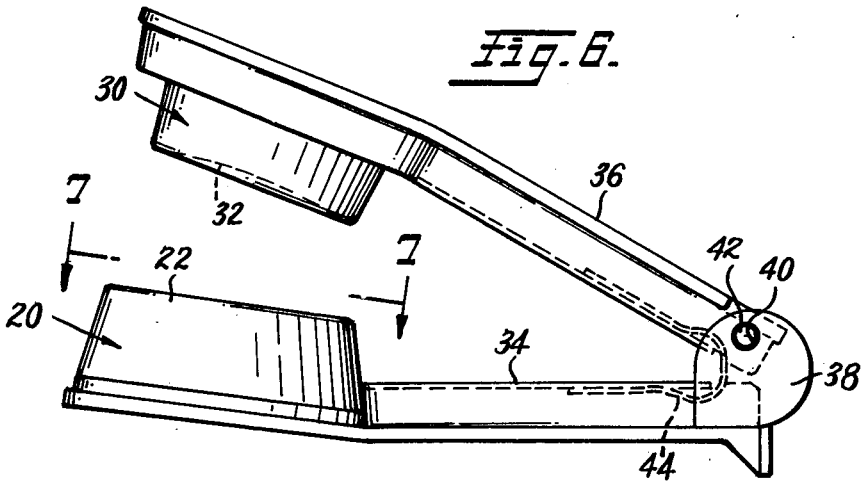
Fig. 6.
Fig. 7.
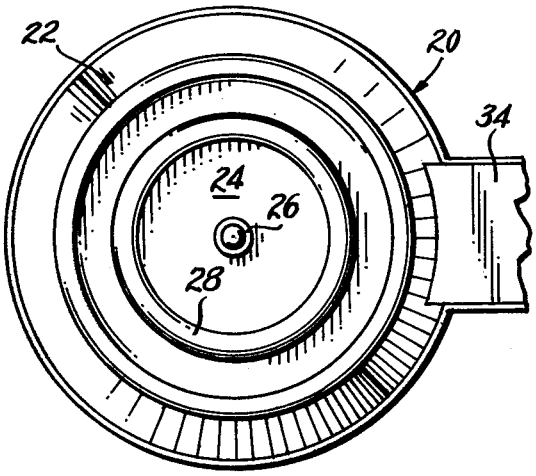
Fig. 8.
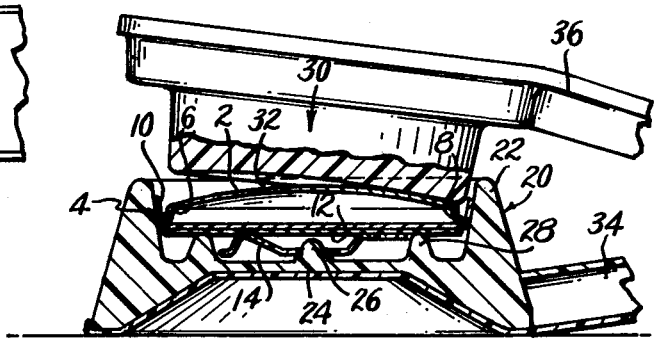
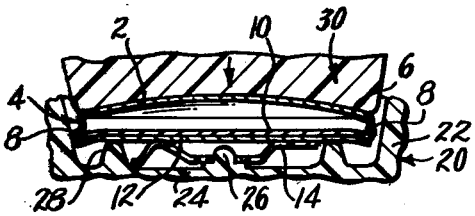
Fig. 9.
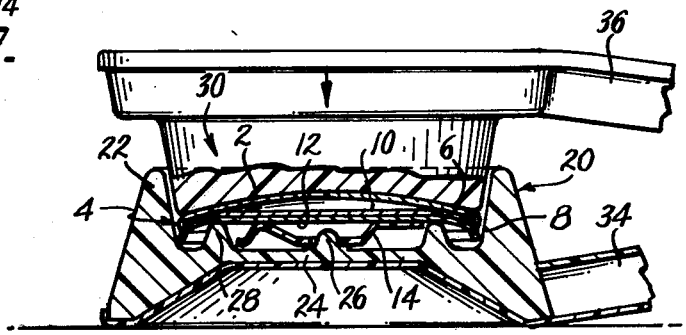
Fig. 10.

REUSABLE BADGE

BACKGROUND OF THE INVENTION

This invention is in the field of display badges adapted to be worn on a person's clothing, for example.

Such badges, of course, are old and well-known. However, in most instances, the badge is a permanent assembly of components and normally cannot be assembled by the user or changed to display different material. Some reusable badges, however, have been proposed as exemplified by U.S. Pat. Nos. 3,407,523 and 3,557,478. The structures of the badges shown in those patents are of a very special nature and do not lend themselves to easy and ready reuse for any desired type of display material. For example, U.S. Pat. No. 3,407,523 apparently requires that the display material be somewhat translucent since his backing member is a reflector. Furthermore, the display material must be precut to proper size and shape. In U.S. Pat. No. 3,557,478, a metal frame ring is employed with a flat transparent member and the display material is held in place by a spring wire arrangement engaged within the metal frame.

It has also been proposed to provide presses for assembling the components of badges, see for example, U.S. Pat. Nos. 3,795,036 and 3,600,783. The operation of those presses, however, requires a multiplicity of sequential steps with the changing of dies or anvil members, in sequential steps, to assemble the components for a permanent badge.

SUMMARY OF THE INVENTION

The present invention provides a badge structure and apparatus for assembling the same capable of easy manipulation, even by a child, and wherein the badge can be disassembled and reused with different display material. A sheet containing the display material may be merely placed between badge components and the subsequent assembly steps thereof automatically severs the display material to the proper size during the assembly process. Thus, even a child may select, for example, a comic strip character from a newspaper, and merely place the badge components in proper relation thereon and the selected material will be severed and retained in the badge after assembly.

In general, the badge comprises a concavo-convex lens of transparent sheet material having a peripheral flange into which a backing member may be snapped for releasable retention. The display material is placed between the lens and backing member. A clip on the backing member constitutes positioning means to locate the same in a press assembly so that the component parts may be superimposed in the press and a hammer member operated in a single manipulation to assemble the parts.

BRIEF DESCRIPTION OF THE DRAWINGS

FIG. 1 is a front view of a badge embodying the present invention;

FIG. 2 is a rear view thereof with fragmentary portions broken away;

FIG. 3 is a rear view of an alternative form of backing member;

FIG. 4 is a still further alternative form of backing member;

FIG. 5 is a sectional view through FIG. 4 on the lines 5—5;

FIG. 6 is a side view of a press according to the present invention;

FIG. 7 is a fragmentary plan view of the anvil portion of the press of FIG. 6, as seen from the line 7—7;

FIG. 8 is a sectional view through the press of FIG. 6 with the parts in an initial position;

FIG. 9 is a sectional view similar to a portion of FIG. 8 showing the parts in a further relative stage of the assembly operation; and FIG. 10 is a view similar to FIG. 8 but showing a press at the end of its badge assembling stroke.

DESCRIPTION OF THE PREFERRED EMBODIMENTS

As shown in the drawings, the completed badge comprises a concavo-convex lens 2 formed from a sheet of transparent but resilient plastic material. As best seen in FIGS. 8–10, the lens is provided with a peripheral flange 4 extending rearwardly from its concave face and being somewhat inwardly bent to define an inwardly facing peripheral groove 6 and an outwardly directed flange portion 8. In FIGS. 2 and 8–10, numeral 10 designates a display member containing the information or indicia to be displayed by the badge, for example, the cartoon figure depicted in FIG. 1. A backing plate 12 is of a diameter slightly larger than the normal diameter of the groove 6 and is formed of resilient but relatively stiff or rigid material which is preferably of a plastic composition whereby it may be molded to the desired shape. In the assembled badge, as best seen in FIG. 10, the outer edge portion of the backing plate 12 is flexed somewhat rearwardly so that its over-all diameter is small enough to reside in the groove 6 and the resilience of the backing member tends to restore it to a nearly flat configuration near its peripheral edge to firmly engage within the groove 6 and thus securely retain the display member 10 between itself and the lens 2. Secured to the rear face of the backing plate 12 is a resilient clip 14 which may be a separate member adhesively secured to the backing plate 12, as shown in FIGS. 2 and 8–10, or which may be integral therewith as indicated at 16 in FIGS. 4 and 5. In the latter embodiment, the clip may be struck from the backing plate or molded initially in the configuration shown in FIG. 5. Obviously, the clips 14 or 16 serve to retain the badge on an article of clothing or other suitable support in a well-known manner.

As also clearly shown in FIGS. 2–5, the clips 14 and 16 are provided with an opening 18 substantially coincident with the center of the circular backing plate, for a purpose to be described.

As shown in FIGS. 2, 4, and 5, the backing plate has a smooth continuous outer periphery whereas in FIG. 3, the outer periphery is shown as being serrated, for a purpose also to be described later.

The press structure by which the badge of FIG. 1 is easily assembled is illustrated in FIGS. 6–10 wherein numeral 20 indicates generally a cup-shaped anvil having a peripheral side wall 22 defining a downwardly tapered inner surface and a bottom 24. A centering boss 26 projects upwardly from the center of the bottom 24 in position to enter an opening 18 in the clip 14 of a backing member placed therein as shown. Surrounding the centering boss 26 is a circular rib 28 extending around the boss in spaced relation thereto and also spaced inwardly from the side walls of the cup-shaped anvil. The parts are so dimensioned that the outer periphery of the backing plate 12 is spaced inwardly from the adjacent side walls 22 of the anvil. With the backing plate in such position, the user may place that portion of a sheet 10 bearing the desired material over the backing plate 12 and even though the display sheet is larger than necessary, its outer edges may be bent upwardly so that the desired portion of the sheet may be placed flat against the backing plate. Thereafter the concavo-convex lens is placed over the display sheet in the manner clearly illustrated in FIG. 8.

A hammer body 30 is provided with a lower surface 32 formed as a shallow concavity shallower than that which would match the convex surface of the lens 2. Thus, when the anvil 30 is pressed downwardly as indicated in FIG. 9, it tends to somewhat flatten the lens 2 and project its flange edge 8 outwardly. The pressure thus applied is transmitted through the peripheral flange 4 to the outer edge portion of backing plate 12. Since the latter is supported by the circular rib 28, the outer edge portion of the backing plate is flexed downwardly as also indicated in FIG. 9. It is to be noted that the flange edge portion 8 of the lens defines an upwardly tapering peripheral surface which acts as a camming surface to cam the outer edge of the backing plate into the groove 6 upon the application of further downward pressure by the hammer 30. The final position is shown in FIG. 10 wherein the lens 2 has been snapped over the display sheet 10 and backing plate 12 to a completely assembled position. The hammer 30 may then be withdrawn from the anvil 20 and the badge removed ready for use.

As previously described, the display sheet 10 may be of greater dimension than the backing plate 12 to project outwardly therefrom as shown in FIG. 8. As the lens 2 is snapped downwardly over the edge of the backing plate, the outer edge of the latter serves as a shearing edge to shear from the sheet 10 only that circular portion serving as the display material in the assembled badge. In some instances a backing plate with the serrated edge shown in FIG. 3 will provide better cutting action than the continuous smooth edge of FIG. 4.

After such a badge has been assembled and used, it may be easily disassembled by flexing the lens, or at least its flange 4, to release the backing plate therefrom and the latter may be removed and the described assembly steps repeated to position a different display sheet 10 in the badge if and when desired.

As also shown in FIG. 6, the anvil 20 and hammer 30 are fixed to laterally extending arms 34 and 36. Bracket elements 38 on the arm 34 are perforated at 40 to receive a stub shaft or pivot member 42 carried by or extending through the arm 36 and a suitable spring 38 is arranged to urge the arm 36 upwardly relative to the arm 34 to normally hold the described parts of the assembly press in the open position shown in FIG. 6. It is contemplated that the anvil 20 and its arm 34 be a unitary molded structure and that the hammer 30 with its arms 36 also be a unitary structure. However, any suitable arrangement may be employed.

From the foregoing it will be apparent that a simple means has been provided for assembling components of a badge in a single easy step capable of being performed even by children and that the badge may be disassembled and reassembled for further use without complicated procedures or without the use of special tools.

While a limited number of specific embodiments have been shown and described, the same are merely illustrative of the principles of the invention, the scope of which is limited only by the appended claims.

I claim:

1. A reusable badge comprising:

a Concavo-convex lens member of transparent resilient plastic sheet material having a peripheral flange extending from its concave face, said flange defining an inwardly facing peripheral groove;

a resilient plate adjacent the concave face of said lens member with its peripheral edge portion being flexed radially inwardly and snap seated in said peripheral groove to be resiliently and releasably retained therein;

said peripheral flange being provided outwardly of said peripheral groove with an outwardly flared surface portion whereby said backing plate may be forcibly cammed into said peripheral groove; and a clip member at the outer face of said backing plate within the outline thereof.

2. A badge as defined in claim 1 wherein said lens and backing plate are substantially circular and wherein said clip member is provided with an opening therethrough coinciding with the center of said backing plate.

3. A badge as defined in claim 1 wherein said backing plate is normally flat but resiliently distortable to concavo-convex shape.

* * * * *